United States Patent [19]

Kitagawa

[11] 3,942,297

[45] Mar. 9, 1976

[54] FRAMEWORK FOR HOUSING AUTOMOBILES OR THE LIKE

[75] Inventor: Isoichi Kitagawa, Yokohama, Japan

[73] Assignee: Hokuzen Shokai Co., Ltd., Yokohama, Japan

[22] Filed: May 1, 1974

[21] Appl. No.: 465,791

[52] U.S. Cl. ..... 52/637; 52/638; 52/646; 52/726

[51] Int. Cl.[2] ..... F04H 12/00

[58] Field of Search ..... 52/637, 638, 648, 650, 52/646, 236, 234, 588, 582, 520, 79, 726, 227, 223, 721; 182/178; 211/182, 177; 403/314, 296, 245, 327, 329

[56] References Cited

UNITED STATES PATENTS

| | | | |
|---|---|---|---|
| 2,361,614 | 10/1944 | Dugan et al. | 52/638 |
| 2,473,388 | 6/1949 | Rambo | 403/327 X |
| 3,037,588 | 6/1962 | Causey | 52/637 |
| 3,138,398 | 6/1964 | Silverman | 211/182 X |
| 3,268,252 | 8/1966 | Rolland | 403/296 |
| 3,394,519 | 7/1968 | Tischuk | 52/520 X |
| 3,500,595 | 3/1970 | Bennett | 52/726 X |
| 3,505,768 | 4/1970 | Bentley | 52/236 X |
| 3,541,746 | 11/1970 | Scott | 52/726 X |
| 3,643,988 | 2/1972 | Ingvartsen | 211/182 X |
| 3,720,031 | 3/1973 | Wilson et al. | 52/520 |
| 3,807,120 | 4/1974 | Viandon | 52/638 |
| 3,824,750 | 7/1974 | Antoniou | 52/79 |

*Primary Examiner*—Ernest R. Purser
*Assistant Examiner*—Carl D. Friedman
*Attorney, Agent, or Firm*—Frank J. Jordan

[57] ABSTRACT

A framework for housing automobiles or the like including, as its main components, joint base plates, vertical and horizontal pipes, and diagonal beams, and capable of being assembled side by side and one on the other.

3 Claims, 40 Drawing Figures

FIG. 6
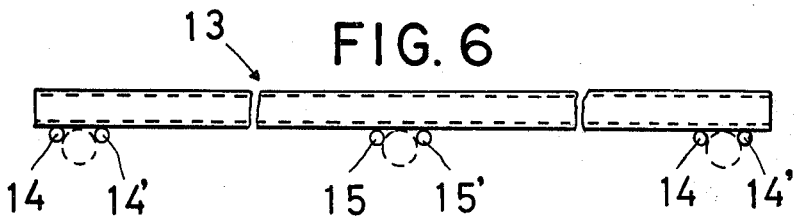
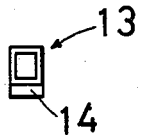
FIG. 7
FIG. 8
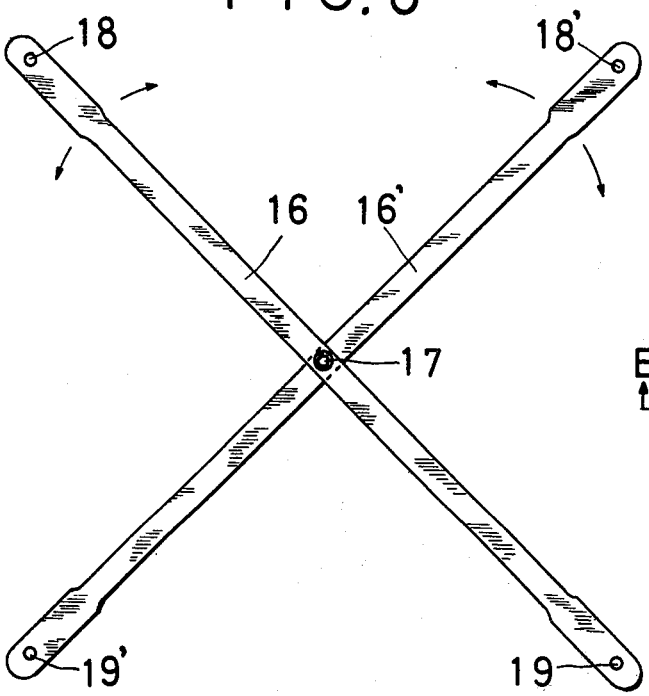
FIG. 12
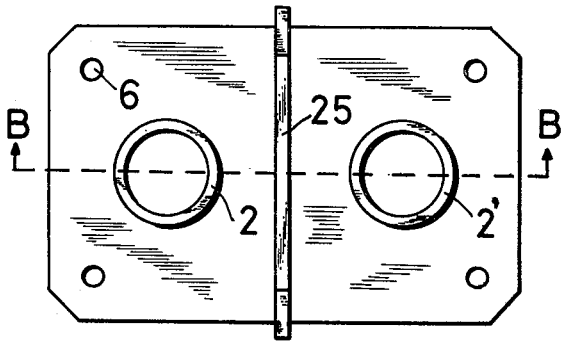
FIG. 13
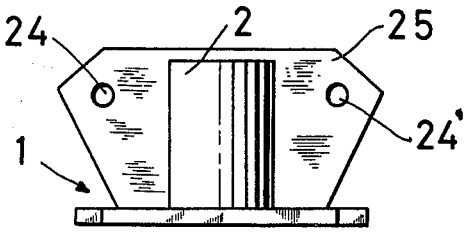
FIG. 14
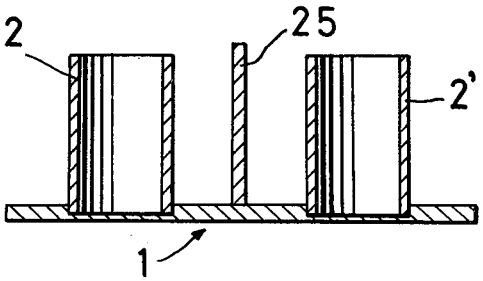

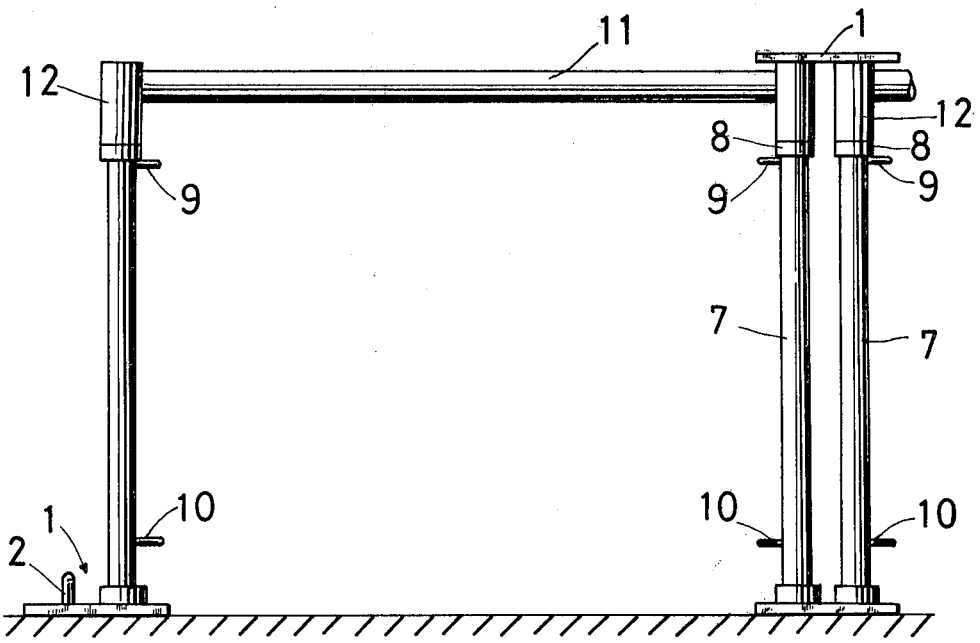
FIG. 9
FIG. 10
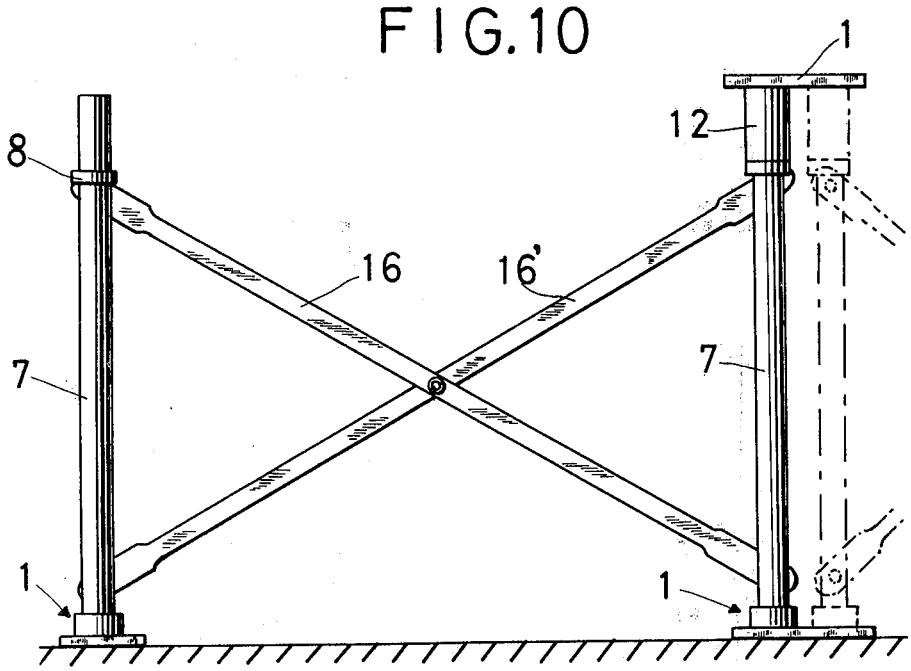

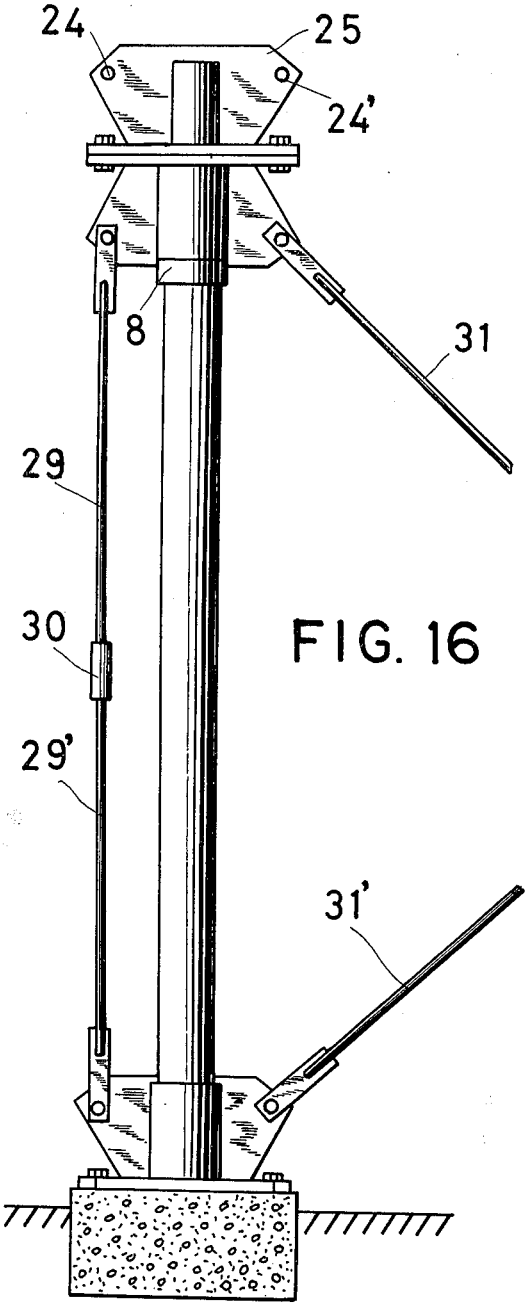
FIG. 16
FIG. 18
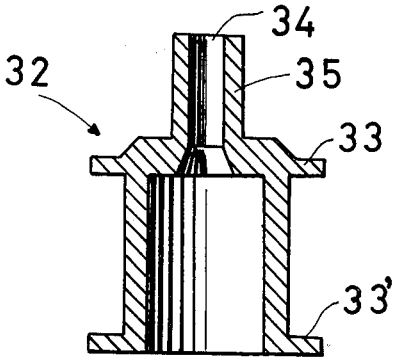
FIG. 19
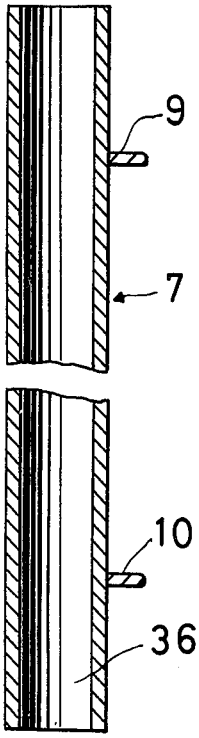
FIG. 20
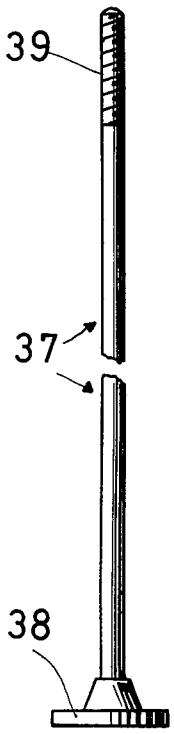
FIG. 17
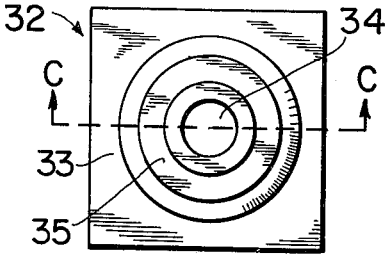

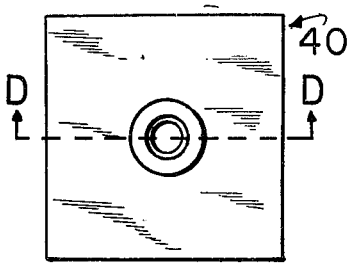
FIG. 21
FIG. 22
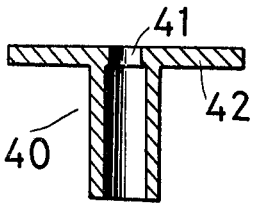
FIG. 23
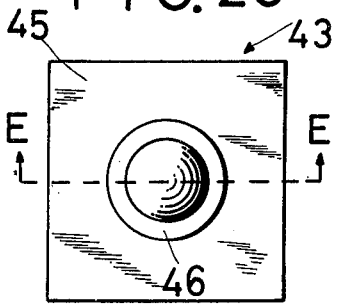
FIG. 24
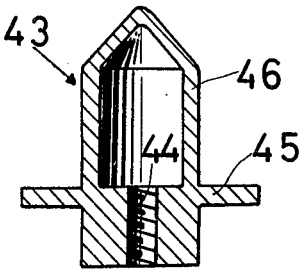
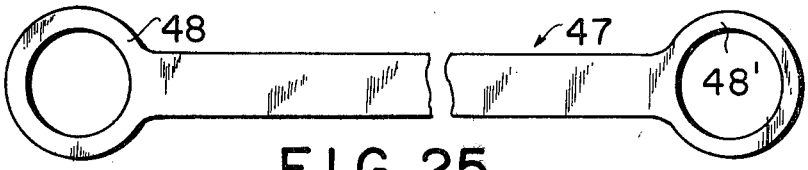
FIG. 25
FIG. 26
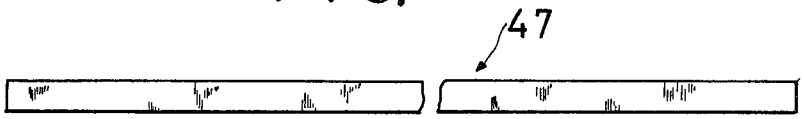
FIG. 27
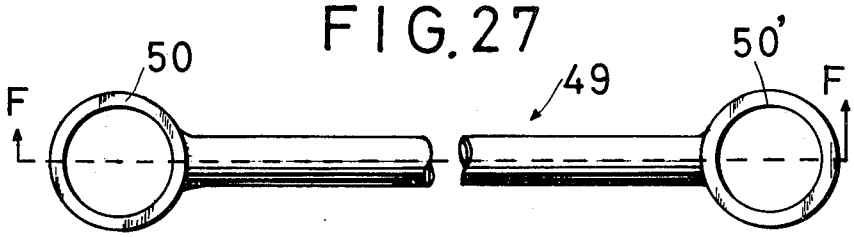
FIG. 28
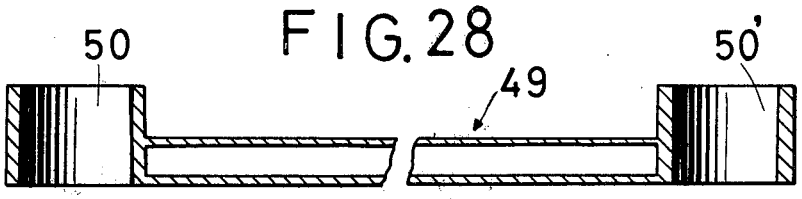
FIG. 29
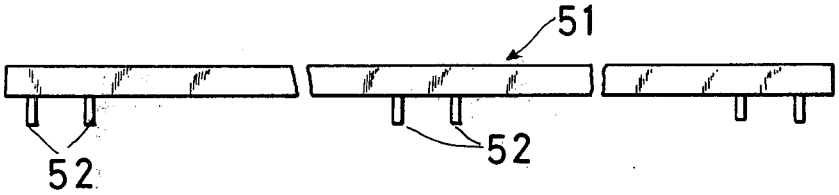
FIG. 30
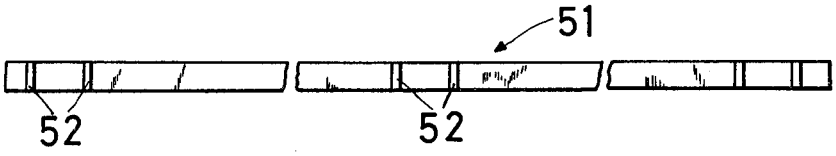

FRAMEWORK FOR HOUSING AUTOMOBILES OR THE LIKE

BACKGROUND OF THE INVENTION

The present invention relates to a framework for use in transporting or housing automobiles or goods (hereinafter refered to as automobiles or the like) and, more particularly, a framework capable of being assembled in the hatch of a ship or at a harbour for the purpose of shipping or temporarily housing automobiles or the like. Further, the present invention relates to a framework capable of being used as a common garage for automobiles.

Conventionally, there have been used foldable containers built with heavy iron frames to transport automobiles or the like. However, these containers have had functional disadvantages that: for example, these containers can be used only in such a manner as a unit of container per an automobile, of whatever size it may be; cranes, fork lifts or the like are needed to install or move these containers; the space necessary for housing automobiles or the like is occupied by these empty containers after use; total weight of automobiles or the like to be loaded in a ship must be greatly reduced due to the weight of these heavy containers; and the cost per unit of container is noneconomically high. These disadvantages as mentioned above have become a barrier in transporting automobiles or the like.

Further, conventional steps adopted to temporarily house automobiles or the like at the harbour were to instal permanent garages or to park automobiles or the like in wide open spaces. However, these steps have resulted in high cost in building permanent garages and made it disadvantageous to load or unload automobiles or the like into or from a ship at a narrow harbour.

Further, in order to park numerous automobiles gathering to, say, a fair, there has been no efficient step but using wide open spaces.

The present invention is intended to eliminate the above mentioned disadvantages encountered at the time of housing automobiles or the like. Therefore, an object of the present invention is to provide a framework permitting both assembly and dismantling thereof to be easily accomplished when used for shipping automobiles or the like in a ship and wherein the dismantled components of the framework after use occupy an extremely small space. A further object of the present invention is to provide a framework capable of housing numerous automobiles or the like in a narrow space at a harbour. Another object of the present invention is to provide a framework permitting both assembly and dismantling thereof to be easily accomplished when used for temporarily accommodating numerous automobiles or the like in a small space.

Other objects and other advantages of the present invention will be clearly understood from the following description of some preferred embodiments of the present invention taken along with the accompanying drawings wherein:

BRIEF DESCRIPTION OF THE DRAWINGS

FIGS. 1 through 11 show a first embodiment of the present invention, in which;

FIG. 1 is a plan view of a joint base plate,

FIG. 2 is a sectional view taken along the line A—A in FIG. 1,

FIG. 3 is an elevational view of a vertical pipe,

FIG. 4 is a side view of the vertical pipe as shown in FIG. 3,

FIG. 5 is an elevational view of a horizontal pipe,

FIG. 6 is a side view of a partly cut away beam for supporting floor decks,

FIG. 7 is an elevational view showing the end of the beam as shown in FIG. 6, FIG. 8 is an elevational view of diagonal beams, FIG. 9 is an elevational view showing the state in which the vertical and horizontal pipes are assembled on the joint base plates, FIG. 10 is a side view showing the same state as shown in FIG. 9, FIG. 11 is an elevational view showing the state of the framework in which an automobile is accommodated therein;

FIGS. 12 through 16 show a second embodiment of the present invention, in which;

FIG. 12 is a plan view of a joint base plate,

FIG. 13 is a side view of the joint base plate,

FIG. 14 is a sectional view taken along the line B—B in FIG. 12,

FIG. 15 is an elevational view showing the state in which the framework is assembled, FIG. 16 is a side view showing the same state of the framework as shown in FIG. 15, FIGS. 17 through 33 show a third embodiment of thhe present invention, in which;

FIG. 17 is a plan view of a base,

FIG. 18 is a sectional view taken along the line C—C in FIG. 17,

FIG. 19 is a sectional view of the vertical pipe,

FIG. 20 is a side view of a core rod,

FIG. 21 is a bottom view of a member for fixing the core rod,

FIG. 22 is a sectional view taken along the line D—D in FIG. 21,

FIG. 23 is a plan view of a nut through which the upper end of the core rod is threaded, FIG. 24 is a sectional view taken along the line E—E in FIG. 23, FIG. 25 is a plan view of a connecting rod, FIG. 26 is a side view of the connecting rod shown in FIG. 25, FIG. 27 is a plan view of an arm pipe, FIG. 28 is a sectional view taken along the line F—F in FIG. 27, FIG. 29 is a side view of a partly cut away beam for supporting floor decks, FIG. 30 is a bottom view of the beam shown in FIG. 29, FIG. 33 is an elevational view showing the same state of the framework as shown in FIG. 31, FIGS. 34 through 40 show an embodiment of the assembly floor deck suitable for use in the framework of the present invention, in which;

DESCRIPTION OF THE PREFERRED EMBODIMENT

Figure 1:
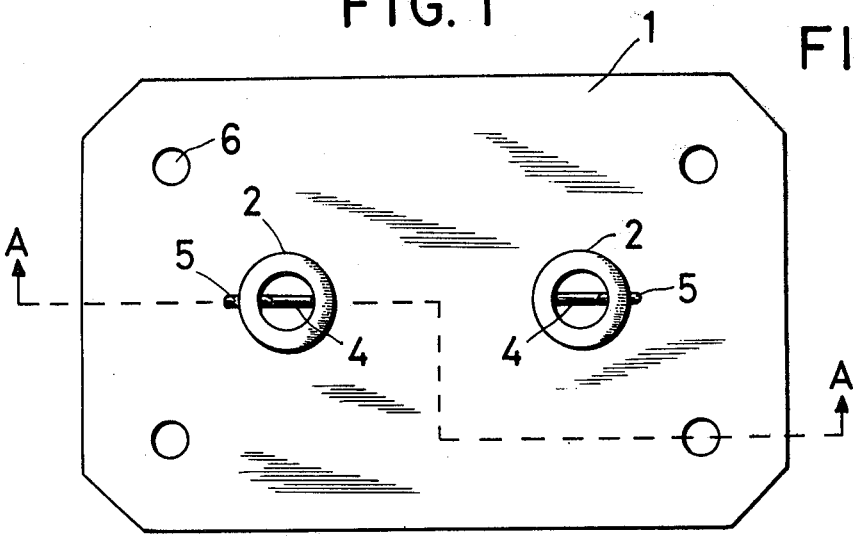
Figure 3:
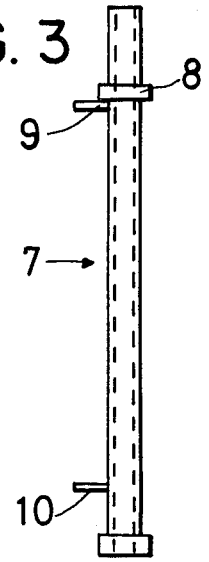
Figure 2:
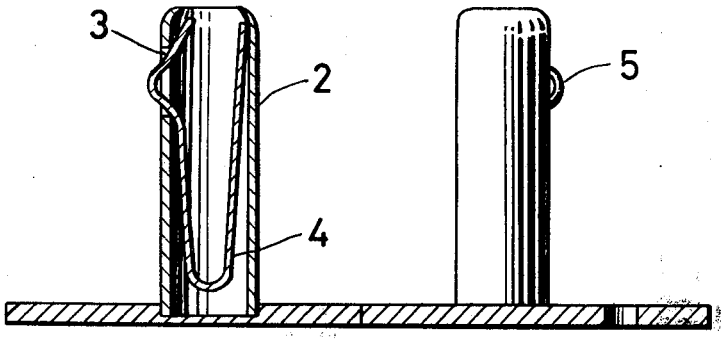
Figure 4:
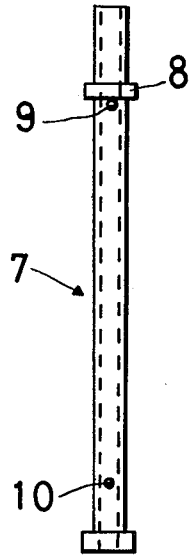
Figure 5:
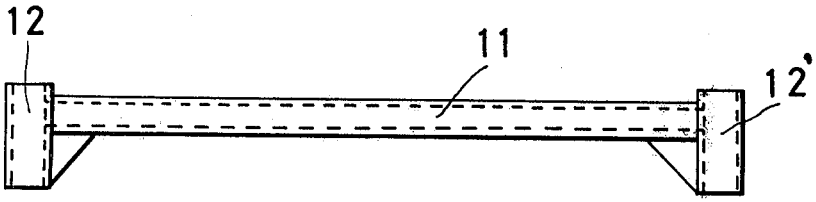
Figure 11:
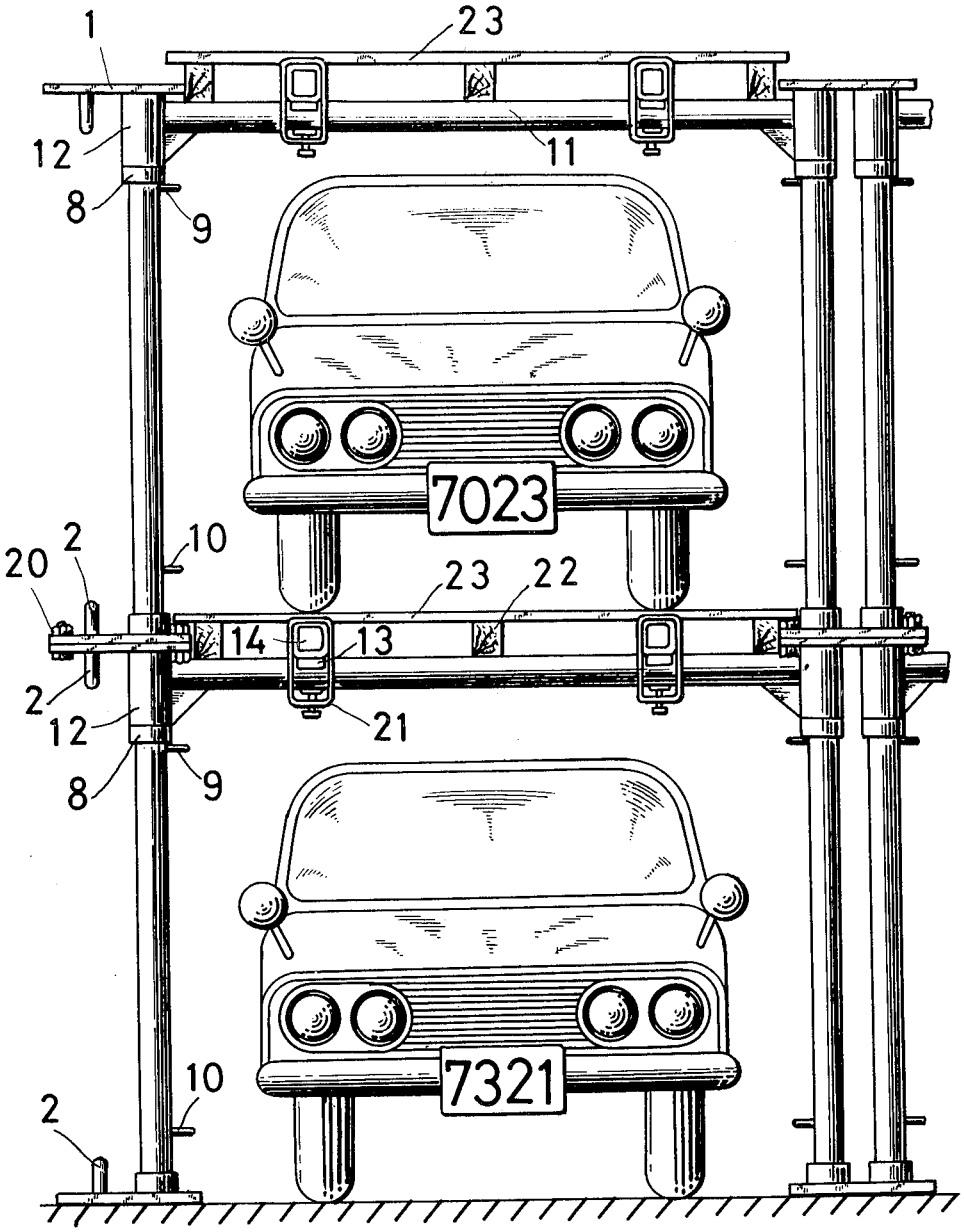

The first embodiment of the present invention will now be described in detail with reference to FIGS. 1 through 10. In FIGS. 1 and 2, reference numeral 1 denotes a joint base plate having two or four leg pipes (two leg pipes are shown in the Figures) secured thereon by welding and four bolt holes 6 provided therein. In each side of the leg pipe there is provided a slit 3, through which the bent portion of the foot of a U-spring 4, which has been inserted into the leg pipe 2, is projected outside. In FIGS. 3 and 4, reference numeral 7 represents a vertical pipe having a collar 8 secured slighly below the upper end thereof and pins 9, 10 secured at one side and at the upper and lower portions thereof. These pins 9,10 are intended to fix diagonal beams which will be later described. Reference numeral 11 in FIG. 5 denotes a horizontal pipe, to both ends of which short pipes 12, 12'are secured respectively perpendicular to the horizontal pipe. These short pipes 12, 12' are placed on the upper end portions of the vertical pipes. Reference numeral 13 in FIG. 6 represents a floor deck supporting beam made of a square pipe, at the bottom face and at the end and central portions of which are provided lock rods 14, 14',15, 15' to be mounted on the horizontal pipes to hold these pipes. Reference numeral 16, 16' denoted diagonal beams having the center secured loosely by a pin 17 as shown in FIG. 8 and both ends thereof are provided with holes 18, 19, 18',19', through which the pins 9, 10 on the vertical pipe 7 are inserted.

The first embodiment of the present invention having the above-mentioned components is assembled by arranging the desired number of joint base plates at predetermined positions, for example, on the deck of a ship; putting the bottom end of each of the vertical pipes 7 on eachh of the leg pipes 2; engaging short pipes 12, 12', provided at both ends of the horizontal pipe 11 onto the upper ends of left and right vertical pipes 7 to be supported by the collars 8 as shown in FIG. 9; and inserting pins 9, 10 of the forward and rear vertical pipes 7 into holes 18, 19, 18', 19' of both ends of the diagonal beams 16, 16' respectively as shown in FIG. 10, thereby to securely fix all of the vertical pipes 7. The bottom portion of each of the vertical pipes is secured stable because the bent portion 5 of the U-spring 4 projected outside through the slit 3 of the leg pipe is urged against the inside of the vertical pipe 7. Alternatively the vertical pipe may be securely engaged with the leg pipe 2 by screwing a threaded bottom portion of the vertical pipe 7 onto a threaded leg pipe 2. Adjacent vertical pipes 7 are connected with each other by inserting the leg pipes 2 of the joint base plate 1, which is reversed upside down, into the upper ends of the vertical pipes 7. As described above, the frameworks of as many units as desired can be rigidly assembled in all derections of the already assembled framework. In case of building the framework one on the other in an upward direction, the joint base plates are mounted on the reversed joint base plates 1 at the upper four corners of the framework assembled as described above and secured with bolts 20 inserted into the bolt holes 6 of these joint base plates 1; onto the leg pipes 2 of the upper joint base plates 1 are put the lower end portions of the vertical pipes 7; onto the upper end portions of the vertical pipes 7 are put the short pipes 12, 12' of the horizontal pipes 11; adjacent vertical pipes 7 are connected with each other by inserting the leg pipes 2 of the reversed joint base plates 1 into the short pipes 12, 12' of the horizontal pipes 11 and the upper end portions of the vertical pipes 7; and diagonal beams 16, 16' are hung by the pins 9, 10 of the vertical pipes 7. Then, floor decks supporting beams 13 are mounted on the horizontal pipes 11 with lock rods 14, 14', 15, 15' thereof holding the horizontal pipes 11 and rigidly secured by fastening members 21 to the horizontal pipes 11. Further, at the center and both ends of the horizontal pipes 11 is mounted support timbers 22 on which are laid any suitable floor decks 23 to load an automobile thereon.

The second embodiment of the present invention will now be described with reference to FIGS. 12 through 16. In FIGS. 12 through 14, the joint base plate 1 has bolt holes 6 and two leg pipes 2, 2', between which is secured a seat plate 25 having holes 24, 24' for fitting pins of reinforcement diagonal beams. The vertical pipe 7 is arranged to be fitted onto the leg pipe 2 of the joint base plate 1, to have a collar 8 at the upper portion thereof and a plate 26 below the collar, said plate being intended to secure a diagonal brace 28. The horizontal pipe 11 has short pipes 12 secured at both ends thereof perpendicular thereto and fitted onto the upper end of the vertical pipe 7. The horizontal pipe 11 has also a plate 27 secured at the underside thereof, said plate 27 corresponding to the plate 26 secured at the side of the vertical pipe 7. Floor deck support timbers 22 are mounted on the vertical pipes 11 on which floor decks are laid to be secured thereon by means of U-fasteners 21.

Figure 15:
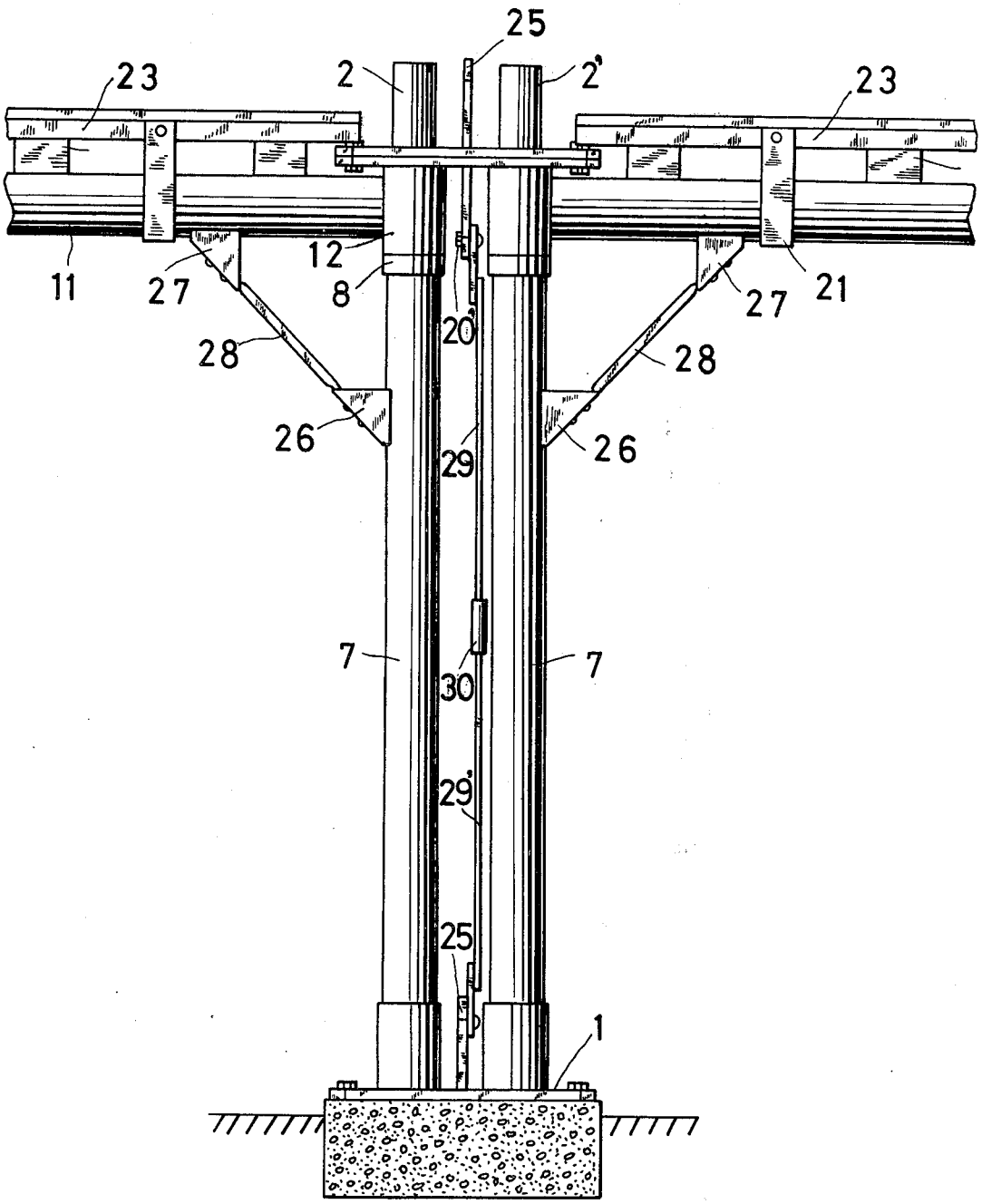
Figure 31:
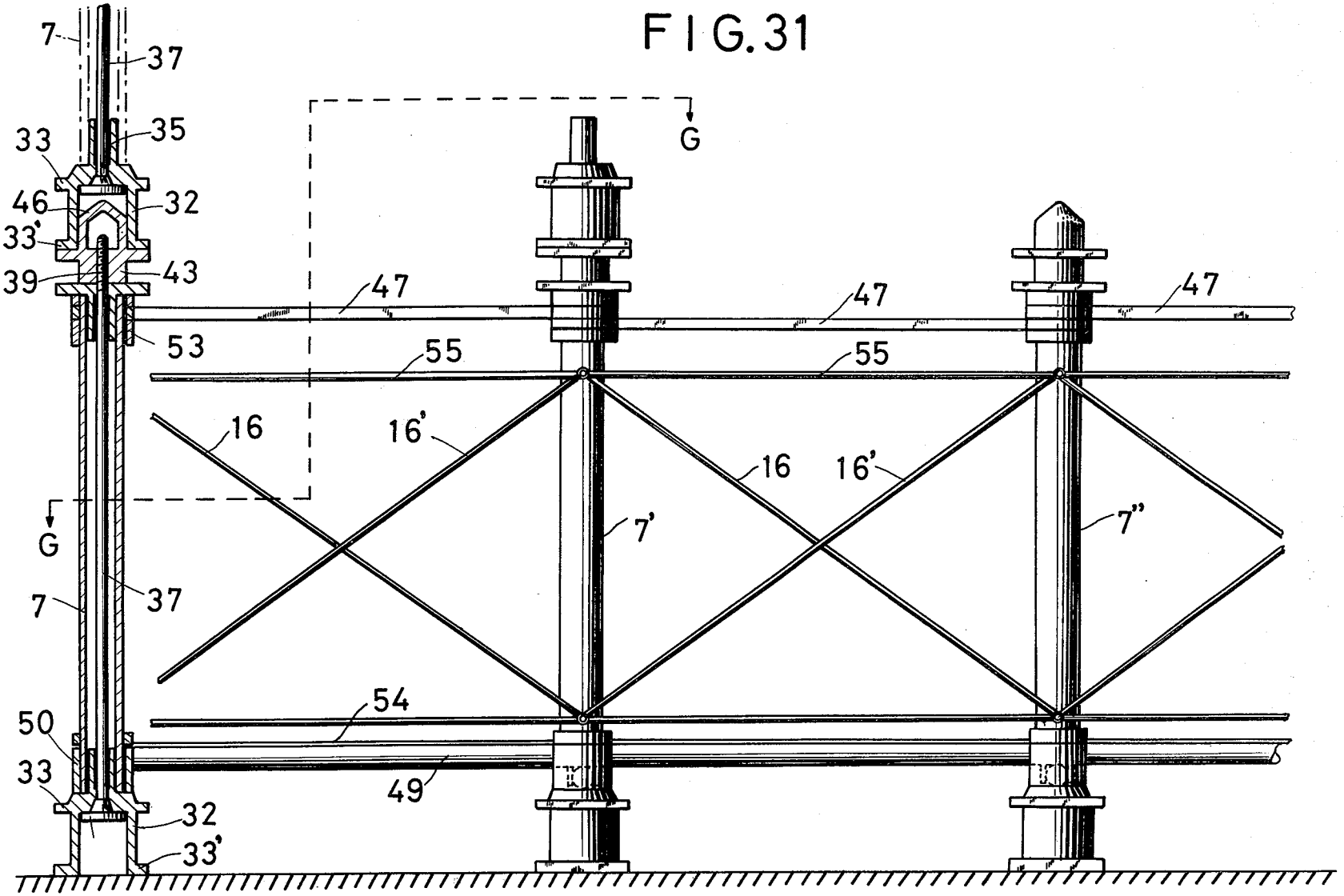
FIG. 31 is a side view, partly cut away, showing the state in which the framework is assembled.
Figure 32:
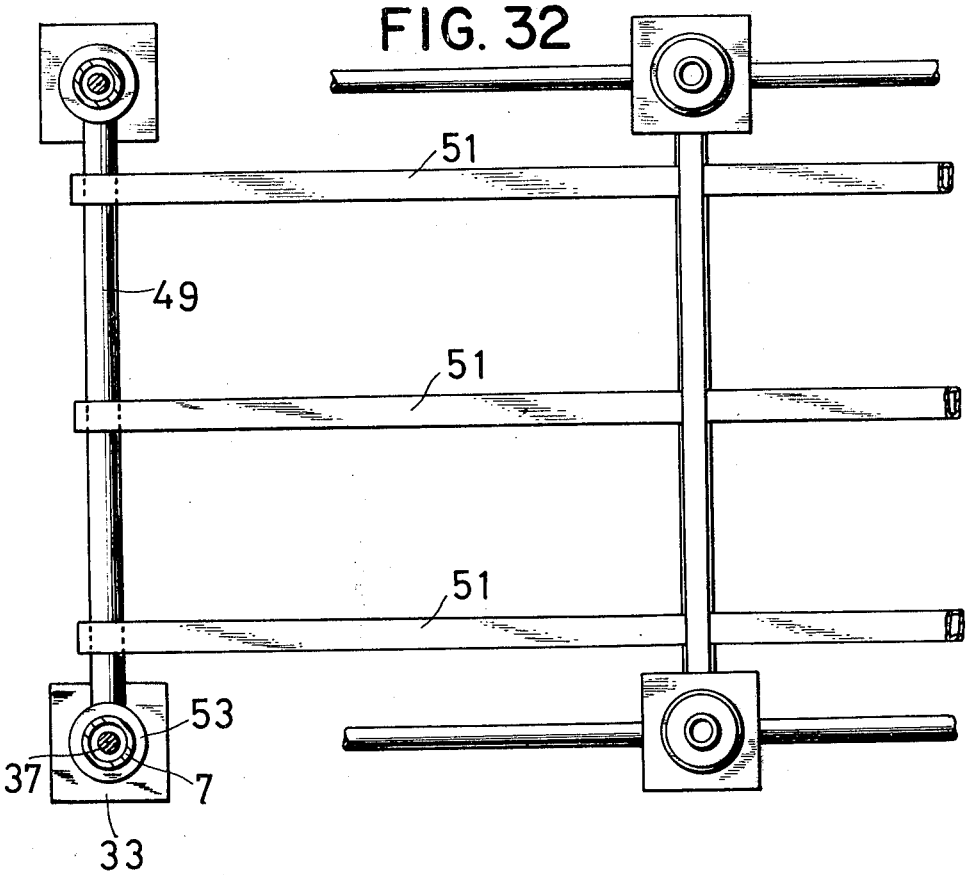
FIG. 32 is a sectional view taken along the line G—G in FIG. 31.

Assembly of these components is made as shown in FIGs. 15 and 16. The joint base plate 1 is bolted to a concrete foundation on the levelled ground or, in case of temporarily installation, directly on the ground; onto the leg pipe 2 of the joint base plate 1 is fitted the lower end of the vertical pipe 7, while onto the upper end of vertical pipe 7 is fitted the short pipe 12 provided at the end of the horizontal pipe 11 to be supported by the collar 8; into the upper ends of the adjacent vertical pipes 7 are inserted the leg pipes 2 of the joint base plate 1 upside down to hold the adjacent vertical pipes 7 stable; and the other short diagonal beams 28 are attached between the plates 26 of the vertical pipes and the ones 27 of the horizontal pipes. In the second embodiment of the present invention, other diagonal beams 29, 29' are further attached at one end of each of the holes 24, 24' of the upper and lower seat plates 25 provided between the leg pipes 2 and 2' of the upper and lower joint base plates respectively and are tightened by means of, for example, a turnbackle 30, while between the seat plates 25 facing diagonally with each other are also attached other diagonal beams 31, 31', thus securing the vertical and horizontal pipes rigidly. On the horizontal pipes 11 of the framework assembled as described above are mounted the floor decks support timbers 22, on which are laid the floor decks to be rigidly secured to the horizontal pipes by means of, for example, U-binders 21. In case of building further frameworks one on the other, after the joint base plates 1 have been bolted through the bolt holes 6 to the reversed joint base plates 1 on the upper ends of the vertical pipes, other vertical pipes are fitted onto the leg pipes 2 of the bolted joint base plates 1 and then an assembly of other components will be made in three dimensions as described above.

The third embodiment of the present invention will be now described with reference to FIGS. 17 through 33. In FIGS. 17 and 18, reference numeral 32 represents a hollow base having rectangular collars 33, 33' at the upper and lower ends and an axially bored projection 35 on the upper collar 35 thereof. In FIG. 19, reference numeral 7 denotes a vertical pipe fitted onto the projection 35 of the base 32, said vertical pipe having pins 9, 10 secured at the side thereof, to which diagonal beams are attached. In FIG. 20, reference numeral 37 is a core rod inserted through the base 32 and the vertical pipe 7, and provided with a collar 38 at the lower end and a thread 39 at the upper end. Reference numeral 40 denotes a fixing member provided with an axial bore 41 through which the upper portion of the core rod is passed, and a rectangular collar 42 at the upper end (see FIGS. 21 and 22). Reference numeral 43 represents a nut having a thread 44 along its central axis so as to engage with the thread 39 of the core rod 37, a hollow projection 46 and a collar 45. The hollow projection 46 functions as support for a hollow projection to be laid thereon when frameworks are further assembled one on the other (see FIGs. 23 and 24). Reference numeral 47 denotes a connecting rod having annular portions 48, 48' at both ends thereof, said annular portions permitting the vertical pipes 7 to be passed therethrough (see FIGS. 25 and 26). Reference numeral 49 represents an arm pipe having also annular portions 50, 50' at both ends thereof (see FIGS. 27 and 28). Reference numeral 51 denotes a floor deck support beam having lock rods 52 welded to the underside thereof, a coupld of said lock rods holding the arm pipes in such a manner that the support beams do not slide when the support beams are mounted on the arm pipes (see FIGS. 29 and 30).

Components of the third embodiment as described above are assembled as shown in FIGs. 31 and 32 by arranging a desired number of the bases 32 at predetermined positions, for example, on the deck of a ship; securing washers 53 and, then, the annular portions 50, 50' of the arm pipes 49 onto the lower portions of the vertical pipes 7; erecting the vertical pipes 7 onto the projections 35 of the bases 32; letting the core rods 37 pass through the axial bores 34 of the bases 32 and the vertical pipes 7 and project above the upper ends of the vertical pipes 7; securing other washers 53' at predetermined portions below the upper ends of the vertical pipes 7; putting the annular portions 48, 48' of the connecting rods 47 onto the upper portions of the vertical pipes 7 and on the washers 53', thus connecting desired number of the vertical pipes with one another; fitting the fixing members 40 into the upper ends of the vertical pipes 7 with the core rods 37 penetrated therethrough to hold them stable; engaging the thread portions 44 of the nuts 43 with the upper thread portions 39 of the core rods 37; mounting the floor decks support beams 51 on arm pipes 49 at the both end and the center thereof, with the lock rods 52, 52' holding the pipes 49 to support the floor decks thereon; and attaching diagonal beams 16, 16' and connecting bars 55 to the sides of the framework thus assembled and diagonal beams 56 to the front and back faces of the framework in such a manner that the diagonal beams 56 can be freely detached.

The above description relates to assembly of the framework in two dimensions, but when the framework is assembled in three dimensions one on the other, the bases 32 having the core rods 37 passing therethrough are put onto the projections 46 of the nuts 43 and the following assembly of other components is made similarly as described above.

There will now be described in detail a floor deck suitable for use in the framework of the present invention. The floor deck is suitable for use, particularly in a framework assembled outdoors in three dimensions and also serves as a roof which prevents dirty water from falling directly on the automobile positioned under the floor deck.

Figure 39:
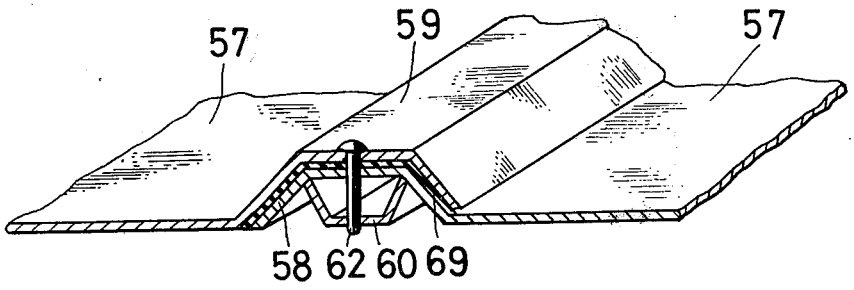
FIG. 39 is a perspective view showing the state in which the decks are connected.
Figure 33:
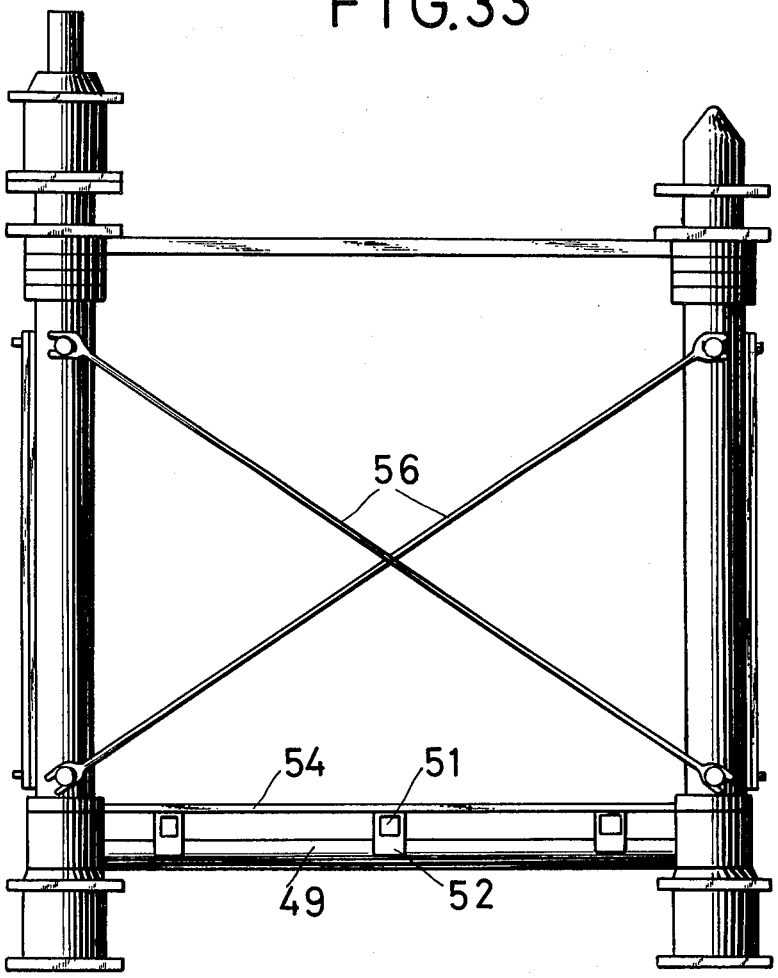
Figure 40:
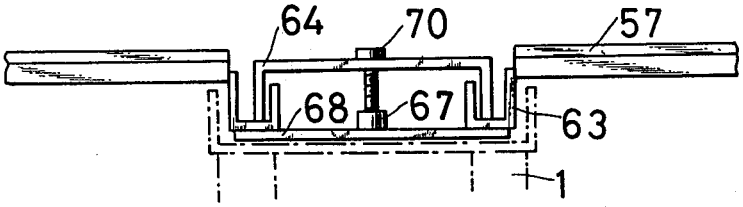
FIG. 40 is an elevational view showing the state in which the floor deck is connected with the trough-shaped connecting plate.
Figure 36:
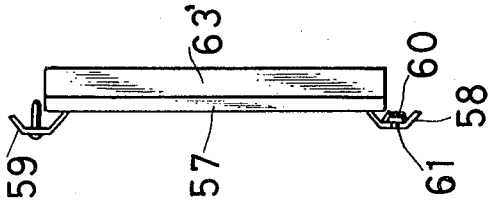
FIG. 36 is a side view of the floor deck shown in FIG. 34.
Figure 34:
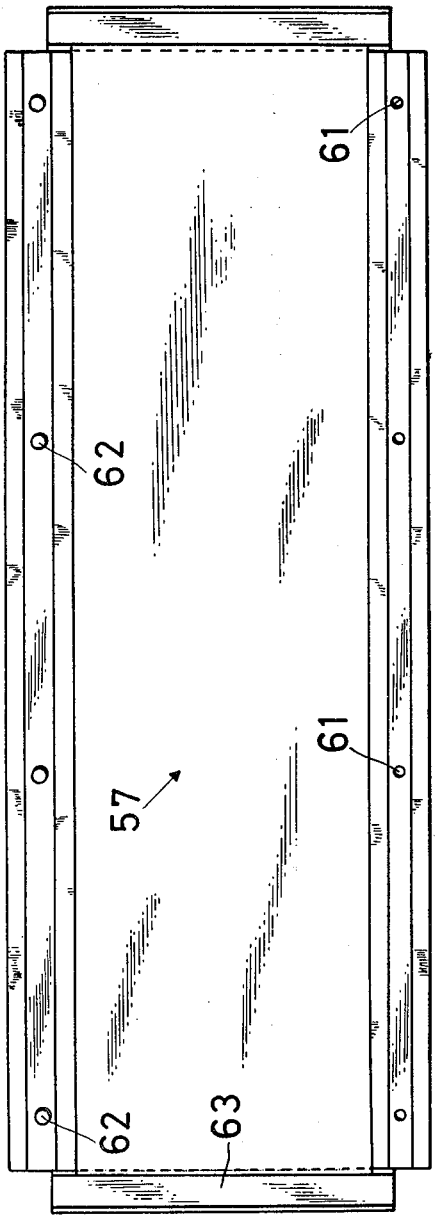
FIG. 34 is a plan view of a floor deck.
Figure 35:
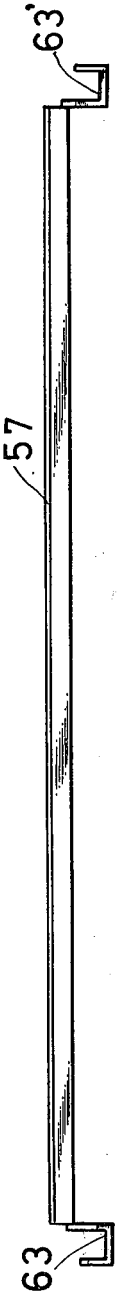
FIG. 35 is an elevational view of the deck shown in FIG. 34.
Figure 38:
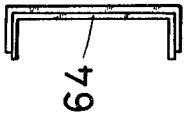
FIG. 38 is a side view of the trough-shaped connecting plate.
Figure 37:
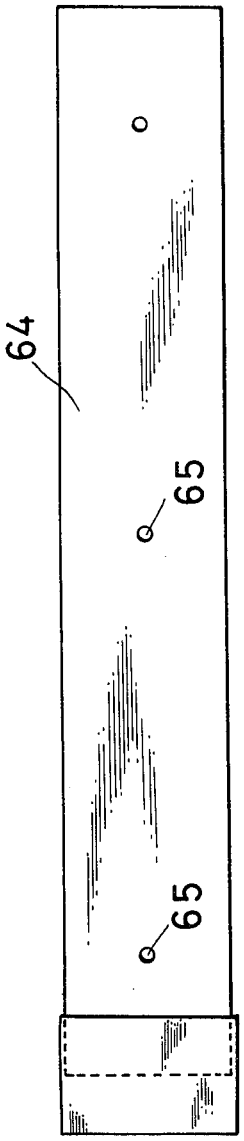
FIG. 37 is a plan view of a trough-shaped connecting plate.

Referring to FIGS. 34 through 36, reference numeral 57 represents a floor deck having convex coupling rims 58, 59 at both longitudinal sides thereof. Along the under face of the coupling rim 58 is welded a U-plate 60, and the coupling rims 58, 59 and the U-Plate 60 are provided with plural bores 61 through which stop pins 62 are inserted. Both left and right sides of the floor deck as shown in FIG. 34 are provided with U-coulping rims 63, 63'. Referring to FIGS. 37 and 38, reference numeral 64 denotes a coupling trough having a section of reversed U-shape and being arranged to be mounted on coupling rims 63, 63' at the both the left and right sides of the floor deck 57. The coupling rough 64 is provided with bolt holes 65 in the upper face thereof. On the floor decks support timbers or beams of the frameworks assembled as already described above are mounted such number of the floor decks as corresponds to that of the assembled framework. Connection between the adjacent floor decks can be accomplished as shown in FIGS. 39 and 40, that is, by mounting the U-trough 64 upside down or the adjacent U-coupling rims 63, 63'; attaching to the under faces of these U-coupling rims a plate 68 on which are fixed female nuts 67 corresponding to the bolt holes 65 in the U-trough 64; inserting bolts 70 through the bolt holes 65 to be screwed into the female nuts 67 respectively and to rigidly secure the coupling rims 63, 63' between the plate 68 and the flanges of the U-trough 64; and water-tightly overlapping on the convex coupling rim 58 the adjacent one 59 with a packing therebetween so as to permit the stop pins 62 fitted in the upper rim 59 to pass through the corresponding bores in the lower rim 58, respectively.

After the floor decks have been coupled with one another, as described above, on the floor decks support timbers or beams of the frameworks alredy assembled side by side and one on the other, slopes are attached to some suitable places of the frameworks so as to enable automobiles to get into or out of each floor of the frameworks.

When the floor decks are applied to the frameworks of the present invention, water falling along various components of the frameworks and contaminated with oil or the like is gathered into the U-channel formed at the connection between the U-coupling rims of the adjacent floor decks to flow out from both ends of the U-channel, thereby preventing contaminated water from falling directly onto the automobiles parked respectively under the floor decks. Further, since the connection between the convex coupling rims of the adjacent floor decks is made only by overlapping one of the coupling rims on the other and inserting stop pins through the corresponding bores of both rims, assembly and dismantling of the floor decks can be easily done only by inserting or removing the stop pins through or from the bores of both rims.

The framework of the present invention for use in housing automobiles or the like as described above can provide such useful effects that: assembly and dismantling of the framework can be easily done; dismantled components of the framework can be kept in a small space, thus making it efficient to use the framework particularly in a ship; increase or decrease of the framework can be easily done; standardization of each of the components of the framework enables mass production and great reduction of cost; each of the components of the framework can be exchanged with a new one, thus making it easy to repair the framework; assembly of the framework does not depended on the space where the framework is assembled; and assembly and dismantling of the frameworks does not require skilled engineers.

What is claimed is:

1. A framework for supporting automobiles and the like comprising elongated vertical support members spaced from one another, interconnecting means received on the longitudinal ends of said vertical support members, said interconnecting means comprising a flat base plate and two cylindrical pipe elements extending from said flat base plate, said two cylindrical pipe elements having axes disposed perpendicular to said base plate, said two cylindrical pipe elements being spaced from one another, a vertical plate secured to said base plate between said spaced cylindrical pipe elements, elongated horizontal support members extending between said interconnecting means, said horizontal support members having cylindrical portions on their longitudinal ends thereof with the axes of said cylindrical portions being disposed substantially perpendicular to the longitudinal axis of the respective elongated horizontal member, said vertical support members and said horizontal support members being disposed in a first generally common plane, and pairs of diagonal support elements extending between said vertical support members and crisscrossing one another at a position intermediate said spaced vertical support members, said diagonal support elements being disposed in a second generally common plane disposed perpendicularly to said first generally common plane, said pairs of diagonal support elements being secured to said vertical plate, support beams extending between said elongated horizontal support members, and flooring means mounted on said support beams, said interconnecting means providing for joining two such interconnecting means one on top of the other of the other to thereby provide for vertical build-up of a plurality of identical frame structures one on top of the other.

2. A framework for supporting automobiles and the like comprising elongated vertical support members spaced from one another, interconnecting means received on the longitudinal ends of said vertical support members, elongated horizontal support members extending between said interconnecting means, said horizontal support members having cylindrical portions on their longitudinal ends thereof with the axes of said cylindrical portions being disposed substantially perpendicular to the longitudinal axis of the respective elongated horizontal member, said vertical support members and said horizontal support members being disposed in a first generally common plane, and pairs of diagonal support elements extending between said vertical support members and crisscrossing one another at a position intermediate said spaced vertical support members, said diagonal support elements being disposed in a second generally common plane disposed perpendicularly to said first generally common plane, support beams extending between said elongated horizontal support members, said interconnecting means providing for joining two such interconnecting means one on top of the other to thereby provide for vertical build-up of a plurality of identical frame structures one on top of the other, and flooring means mounted on said support beams, said flooring means comprising an elongated floor plate, a first convex coupling element disposed along one longitudinal side of said floorplate, a second convex coupling element disposed along the other longitudinal side of said floor plate, said first convex coupling element having a pin protruding therefrom, said second convex coupling element having a U-shaped part secured thereto, said U-shaped part and said second convex coupling element having aligned openings to receive a pin of an adjacent first convex coupling element when two first and second convex coupling elements are arranged in overlapping fashion, and packing means disposed between said overlapping convex coupling elements.

3. A framework according to claim 2 wherein said floor means further comprises U-shaped elements on the longitudinal ends of said elongated floor plates, a base plate element extending betwen two U-shaped elements of a pair of juxtaposed elongated floor plates, an inverted U-shaped element having its two spaced legs disposed in said two U-shaped elements, and fastening means extending between said inverted U-shaped element and said base element for providing a fastened connection between said base plate element and said inverted U-shaped element.

* * * * *